US005553976A

United States Patent [19]

Korsgaard

[11] Patent Number: 5,553,976

[45] Date of Patent: Sep. 10, 1996

[54] FLUID RISER BETWEEN SEABED AND FLOATING VESSEL

[76] Inventor: Jens Korsgaard, 318 N. Post Rd., Princeton Junction, N.J. 08550

[21] Appl. No.: 198,922

[22] Filed: Feb. 18, 1994

[51] Int. Cl.[6] ..... E02B 17/00; E21B 17/01

[52] U.S. Cl. ..... 405/195.1; 37/335; 138/113; 166/359; 166/367; 405/158; 405/169

[58] Field of Search ..... 405/195.1, 169, 405/170, 171, 222, 223, 224, 172, 158, 223.1; 166/350, 351, 359, 367; 37/307, 310, 311, 312, 314, 334, 335; 299/8, 82.1; 138/113, 104, 154, DIG. 11

[56] References Cited

U.S. PATENT DOCUMENTS

| | | | |
|---|---|---|---|
| 785,263 | 3/1905 | MacDonell | 405/195.1 X |
| 3,199,553 | 8/1965 | Garrett et al. | 405/169 X |
| 3,339,512 | 9/1967 | Siegel | 166/351 X |
| 3,817,325 | 6/1974 | Mott et al. | 166/359 |
| 4,067,202 | 1/1978 | Reed | 166/359 X |
| 4,265,567 | 5/1981 | Nybo | 166/367 X |
| 4,362,215 | 12/1982 | Sparks | 166/367 |
| 4,456,073 | 6/1984 | Barth et al. | 405/195.1 X |

*Primary Examiner*—Dennis L. Taylor
*Attorney, Agent, or Firm*—Kenyon & Kenyon

[57] ABSTRACT

An ocean riser assembly for conveying fluids between the seabed and the surface of the sea includes a fluid conveying pipe formed into a helical configuration or into a planar cyclically undulating configuration, such as a sinusoid, that extends longitudinally from the bottom of the sea to the surface. One or more flexible and preferably elastic tension members extend in the longitudinal direction of the riser assembly and are secured to the pipe at spaced intervals, so that they absorb tension forces applied between the ends of the riser assembly. The helical or undulating configuration of the riser pipe decouples axial stresses in the pipe caused by internal fluid pressure from stresses caused by external tension forces acting on the riser assembly, the external tension forces being converted to torque and bending moments acting on the pipe itself. This arrangement permits substitution of carbon steel pipe for flexible pipe, at substantial cost savings. The riser assembly can be used in very deep water, but it also is useful in shallow water, particularly in the planar undulating configuration of the fluid conveying pipe.

15 Claims, 5 Drawing Sheets

FLUID RISER BETWEEN SEABED AND FLOATING VESSEL

BACKGROUND OF THE INVENTION

1. Field of the Invention

This invention relates generally to the deployment and configuration of tubular connections between the bottom of a body of water and a vessel floating on the surface to permit conveyance of liquids or gases under pressure while the vessel is maintained nearly stationary or with only limited movement.

2. Background Art

In offshore oil and gas fields, so-called risers are employed to convey fluids between the seabed and a vessel on the surface of the sea. These risers consist of a conduit or combinations of conduits arranged so that the conduits can deflect sufficiently to remain securely connected even though the vessel is displaced in horizontal and vertical directions due to the combined actions of wind, waves, and currents on the vessel. The vessel may be moored to the seabed through anchor and chain connection, or it may be kept on station by means of a dynamic positioning system of thrusters on the vessel operated to continually counteract the wind, wave, and current forces.

FIGS. 1–4 illustrate typical riser assemblies according to the known art, with the same elements in each figure being designated by the same reference numeral. In FIG. 1, a pipeline 10 on the sea bed 11 connects through a pipeline end manifold 12 to a buoyant rigid pipe riser 13, which can pivot to a limited degree about the manifold 12. The riser 13 connects to a vessel 14, such as a semi-submersible platform, through a flexible pipe jumper 15 (for example, of the type manufactured by Coflexip) to complete the fluid path between the seabed pipeline 10 and the vessel 14. The jumper 15 hangs in a catenary shape between the upper end of the riser 13 and the vessel 14. The catenary of the jumper 15 and the pivoting motion of the riser 13 combine to permit substantial displacement of the vessel 14 in both the vertical and horizontal directions yet still maintain a secure fluid path. The illustrated semi-submersible platform vessel 14 is also moored to the seabed by anchor chains 16 and piles 17.

FIG. 2 shows another example of a conventional riser arrangement in which a flexible pipe 18, having a portion 19 that rests on the seabed 11 and a catenary portion 20, provides a direct connection between the pipeline end manifold 12 and a vessel 21, such as a tanker or a special purpose vessel known as a floating storage and off-loading (FSO) or floating production, storage and off-loading (FPSO) vessel. In this example, the vessel 21 is shown as free floating, being maintained on station by thrusters 22 without separate anchor chains.

FIGS. 3 and 4 show still another known technology whereby a flexible riser pipe 23 connects the pipeline end manifold 12 to a floating vessel 24 through a structural swivel turret 25 rotatably mounted in the bottom of the vessel. In FIG. 3, a plurality of buoyancy tanks 26 spaced along a section of the riser 23 support the riser in an S-curve to provide additional flexibility. In FIG. 4, the plurality of buoyancy tanks 23 are replaced by a single larger buoyancy tank 27 moored by a tether 28 to a clump weight 29 on the seafloor. The tethered buoyancy tank 27 also forces the riser to assume an S-shape in the water, and it has the advantage over the arrangement of FIG. 3 of providing a more positive control of the shape of the riser 23 when fluids of different specific gravities being transferred through the riser change the buoyancy of the pipe. As in the example of FIG. 2, the vessel 24 may be maintained on station by thrusters (not shown), or the vessel may be moored by anchors and chains as in FIG. 1.

The prior art riser technologies illustrated in FIGS. 1–4, all rely on flexible pipe, which may be unsuitable for certain oil field operations, such as pumping down tools. In addition, the existing technologies rely on the strength of the pipe itself to resist axial forces imposed on the riser. Changes in the specific gravity of the contents of the riser or the negative buoyancy of the pipe itself may overstress the pipe axially when the water is very deep, say 1,000 meters or more. The existing technology also does not permit very large motions of the surface vessel when the water is shallow (i.e., only slightly deeper than the draft of the vessel) without danger of damaging the riser either by bending it more sharply than the damage bending radius of the pipe or by chafing it against the vessel, the seabed, or both.

SUMMARY OF THE INVENTION

An object of the present invention is to provide an improved riser assembly that overcomes all of the above stated drawbacks of known riser technologies.

Another object of the invention is to provide an improved riser assembly that does not rely only on the strength of the pipe to resist axial forces imposed on the assembly.

Still another object of the invention is to provide controllable buoyancy for a riser assembly such that the assembly may be maintained essentially neutrally buoyant with fluid contents of different specific gravities to allow use of the riser assembly in very deep water with only modest strength of the riser pipe itself.

A further object of the invention is to provide a riser assembly which does not require flexible pipe, so that pumping down tools can be accomplished without damaging the pipe.

The above and other objects are achieved by a riser assembly comprising at least one elongated fluid conveying pipe having a first end adapted to be located proximate to the seabed and a second end adapted to be located proximate to the surface of the sea, said pipe being formed in one of a helical configuration and a planar cyclically undulating configuration about a longitudinal axis extending from the first end to the second end, and at least one flexible tension member secured to the fluid conveying pipe at at least two spaced apart points along a line extending generally parallel to the longitudinal axis, such that extension of the second end of the fluid conveying pipe more than a predetermined axial distance from the first end causes an increased tension in the tension member.

Preferably the at least two spaced apart points of connection of the tension member are at the first and second ends of the fluid conveying pipe, and the tension member is secured to the fluid conveying pipe at additional longitudinally spaced points intermediate the first and second ends of the pipe.

If the fluid conveying pipe is formed in a planar cyclically undulating configuration, such as a sinusoid, the at least one tension member may comprise a plurality of substantially parallel members spaced from each other, and each member preferably is secured to the pipe at at least one point in each cycle of undulation.

If the fluid conveying pipe is formed in a helical configuration having a cylindrical outer envelope, the at least one tension member may comprise a plurality of tension members extending along lines that coincide with circumferentially spaced elements of the cylindrical envelope, with each tension member being secured to the fluid conveying pipe at spaced apart points intermediate the first and second ends of the pipe, such as at intersections of the corresponding cylindrical element line with the pipe.

If the fluid conveying pipe is formed in a helical configuration, the at least one tension member alternatively may extend along a line that coincides generally with the longitudinal axis, and the riser assembly may further comprise spacer bars extending radially from the tension member to the pipe at longitudinally spaced intervals along the tension member.

Preferably, each tension member is elastically stretchable to permit significant longitudinal extension of the riser assembly in response to increased tension forces imposed between the first and second ends of the fluid conveying pipe.

The tension members may comprise rubber rope, synthetic fiber rope, or steel wire rope, with the tension members ideally being nearly neutrally buoyant. As an alternative in shallow water installations where the longitudinal axis of the riser assembly has a substantial horizontal component, weighted or heavy catenary chains could be used as the tension members.

Preferably, each fluid conveying pipe consists of metallic pipe such as ordinary carbon steel pipe, thus avoiding the need for expensive flexible pipe that can also be easily damaged by certain oil field procedures such as pumping down tools. Standard steel pipe can be used because the helical and cyclically undulating planar configurations decouple the axial forces exerted on the riser assembly by buoyancy and accelerations from the forces created by the internal pressure in the fluid conveying pipe. Internal pressure produces circumferential hoop stress and longitudinal tensile stress in the pipe wall, but external tension and/or compression forces acting on the ends of the riser assembly produce bending moments that translate into shear stresses in the pipe wall, due to the curved configurations of the invention.

For both the mentioned configurations, each flexible tension member typically will be an elastically stretchable rope connected to the pipe such that a predetermined initial prestress tension will be developed in the rope when the first end of the pipe is connected to the seabed and the second end is connected to a vessel at the surface or to a buoy near the surface. When the rope is stretched or relaxed in response to movement of the second end of the pipe away from or toward the first end, the period or pitch of the helix or undulation will change, thereby permitting controlled stretching or compression of the riser. The prestress in each rope simultaneously prevents excessive lateral deflection of the riser and limits uneven longitudinal deflection, thereby keeping the bending stresses of the riser pipe within preselected limits.

The at least one fluid conveying pipe can include a plurality of pipes bundled together, including pipes that function as buoyancy control pipes to maintain the net buoyancy of the riser assembly close to neutral buoyancy, even if the specific gravity of the fluid being conveyed in the riser pipe or pipes changes as a result of changing the composition of the fluid being conveyed. This can be accomplished by making a compensating change in the type of fluid contained in the buoyancy control pipes. For example, concentrated brine could be used in the buoyancy control pipes to make it heavy, fresh water to make it moderately buoyant, and compressed air to make it strongly buoyant.

The above and other features and advantages of the riser assembly of the invention are described in detail below in connection with the drawings.

DETAILED DESCRIPTION OF THE PREFERRED EMBODIMENTS

Figure 1:
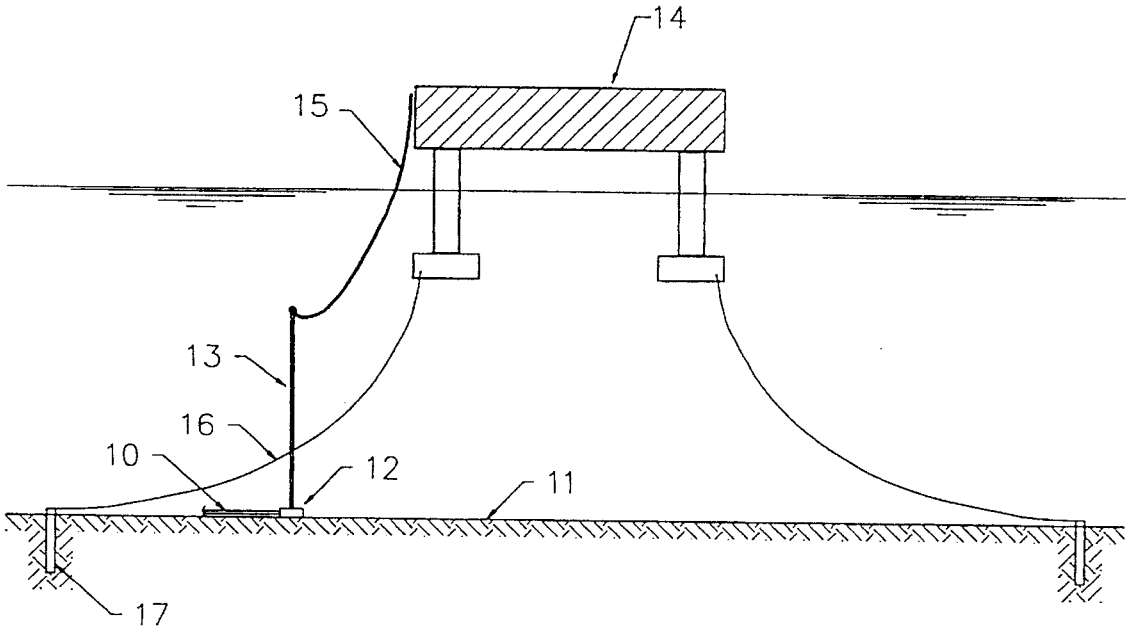
PRIOR ART FIG. 1
FIGS. 1 through 4 are side elevation views of prior art riser assemblies connecting a pipeline on the seabed to a vessel floating on the surface of the water.
Figure 2:
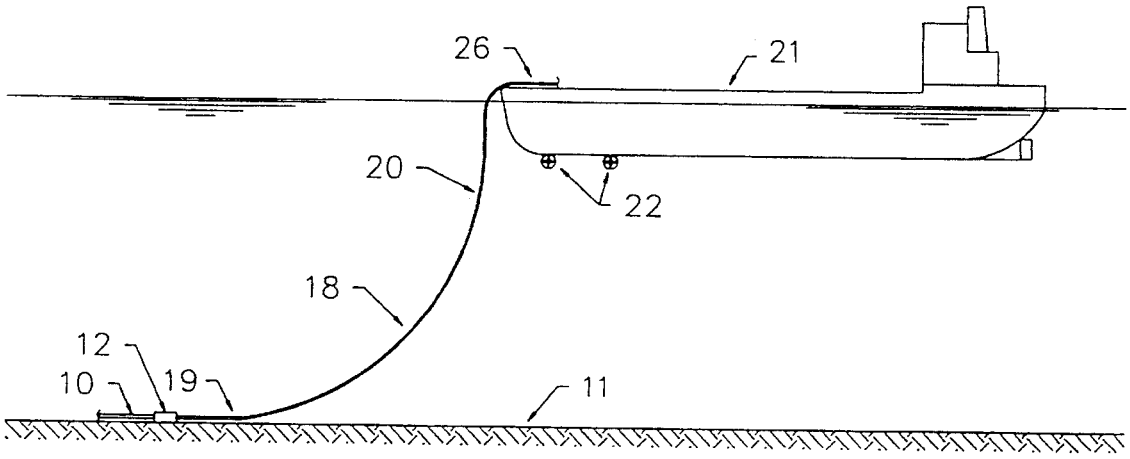
PRIOR ART FIG. 2
Figure 3:
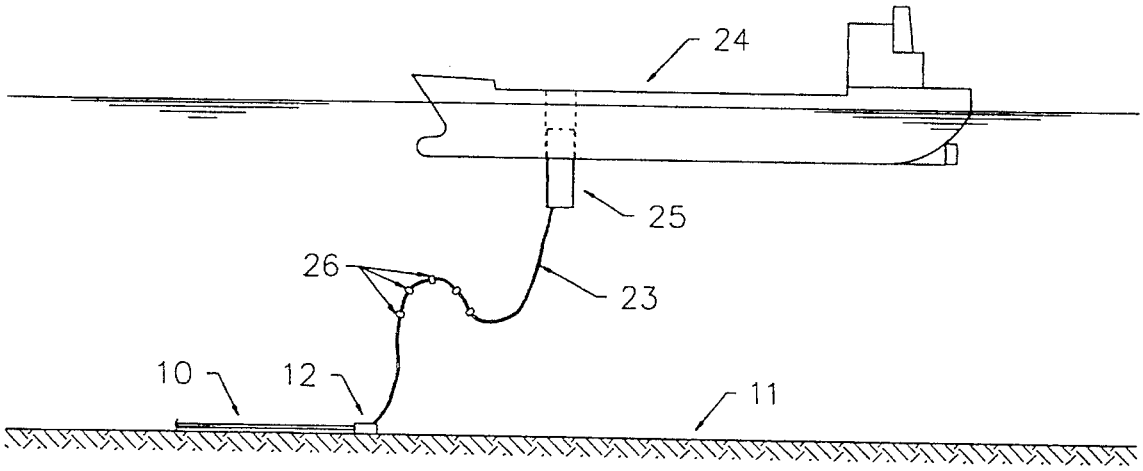
PRIOR ART FIG. 3
Figure 4:
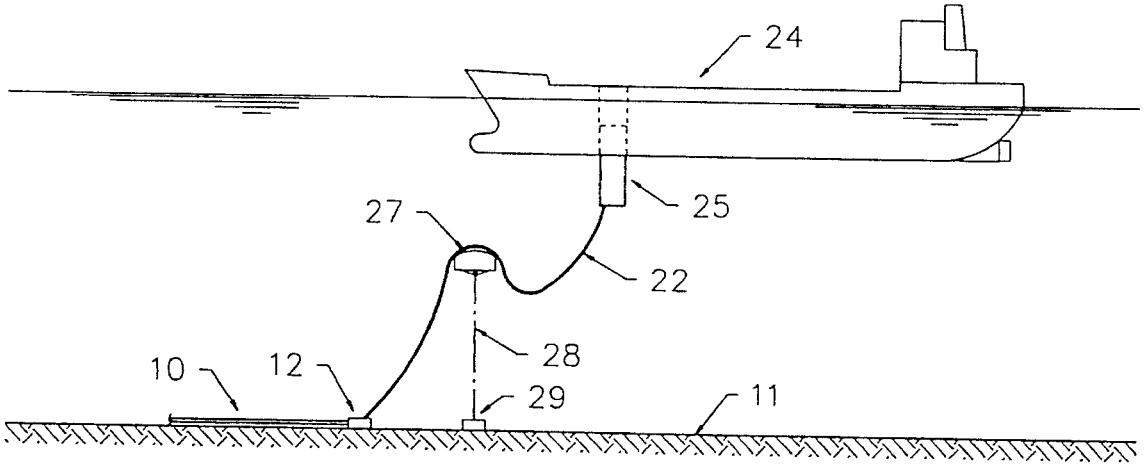
PRIOR ART FIG. 4
Figure 5:
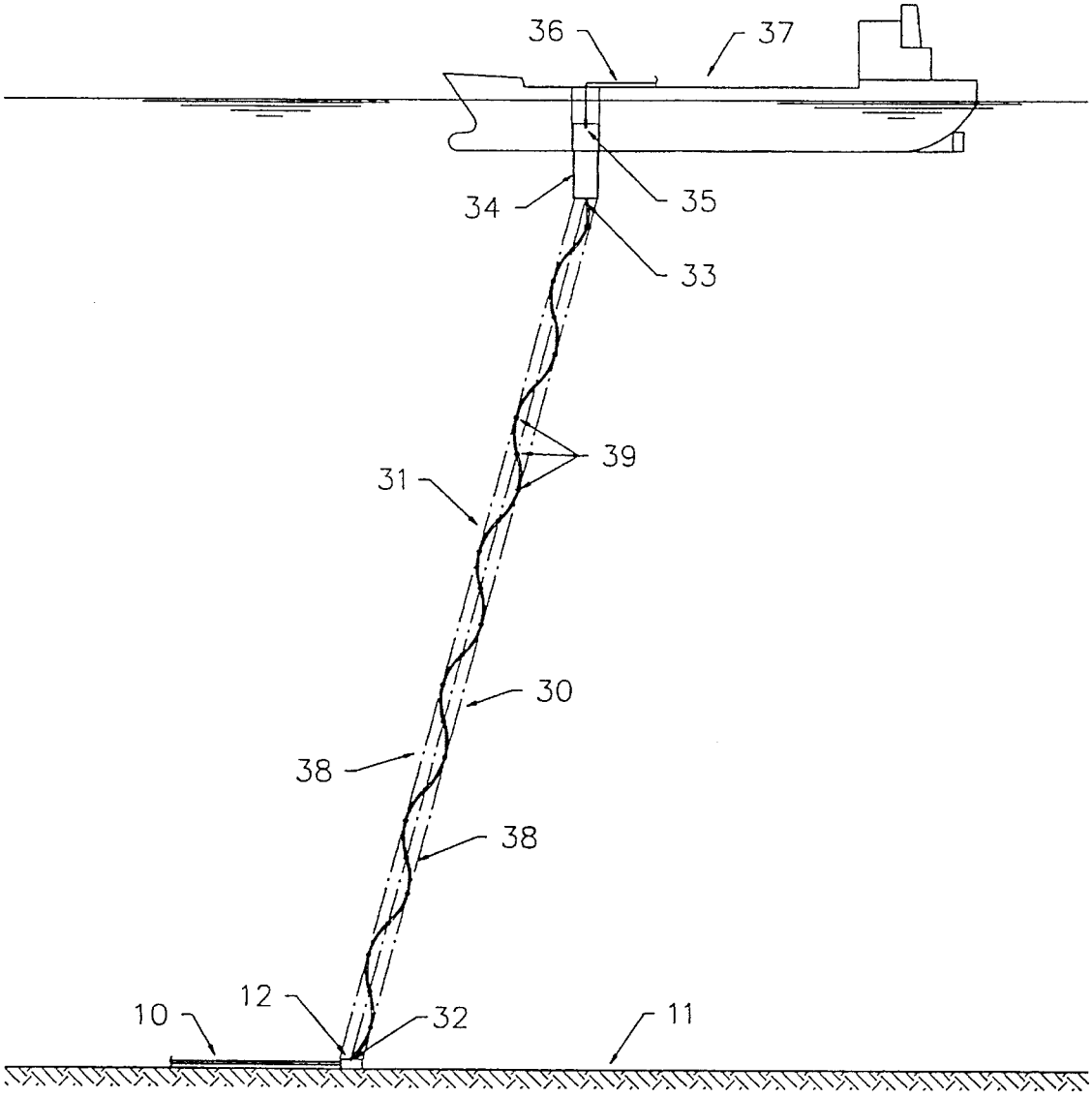
FIG. 5 is a side elevational view of a first embodiment of a riser assembly according to the present invention.

The prior art riser assemblies shown in FIGS. 1–4 have been discussed above in the background section; FIGS. 5–8 illustrate three embodiments of the present invention. With reference to FIG. 5, a pipeline 10 resting on the seabed 11 connects at a pipeline end manifold 12 to a riser assembly 30. The riser assembly 30 includes an elongated fluid conveying pipe 31 that has a first end 32 connected to the manifold 12 and a second end 33 connected through a structural swivel 34, such as a rotatable turret, and a fluid swivel 35 to piping 36 on a floating vessel 37. The structural swivel 34 and the fluid swivel 35 permit the vessel to weathervane while limiting the twist in the riser assembly.

For simplicity only one fluid conveying pipe 31 is shown in FIG. 5, but additional pipes 31' may be bundled together with pipe 31 in a single riser assembly 30. Since the fluid conveying pipe or pipes normally will convey fluids of different density, the net buoyancy of the riser assembly may vary. To counteract such net buoyancy variation, some of the additional pipes 31 in the bundle may function as buoyancy control pipes. When increased net buoyancy is required, the fluid inside the buoyancy control pipes would be replaced with lower density fluid, by actuation of controls (not shown) on the vessel. When decreased net buoyancy is required, heavier fluid may be injected into the buoyancy control pipes.

The pipe 31 is formed in a helical configuration having a longitudinal axis (not shown) that extends from the first end 32 to the second end 33.

The riser assembly 30 also includes at least one flexible tension member 38. FIG. 5 shows four such tension members arranged at 90° intervals around the helical pipe. Each tension member 38 extends in a line generally parallel to the longitudinal axis and contacts each turn of the helical pipe 31 at points 39. The tension members 38 are preferably elastic ropes that may be made of any suitable material, such as rubber, synthetic fiber, or steel wire, depending on the elasticity required to accommodate the movement of vessel 37. The ropes are secured to the pipeline end manifold 12 at the first end 32 of the pipe 31, to the rotatable turret 34 at the second end 33 of the pipe 31 and preferably to each intermediate point of contact 39 of the respective rope with the helix of the pipe 31. Instead of providing buoyancy control pipes, as described above, the riser assembly may include buoyancy modules (not shown) attached to the pipe 31, for example at each contact point 39 of a tension member 38 with the helical pipe 31, so as to make the riser assembly nearly neutrally buoyant.

For moorings in deep water, say in excess of 300 meters, the tension members 38 in the riser assembly may also serve to moor the vessel 37, because a horizontal excursion of the vessel away from a point directly over the pipeline end manifold 12 would stretch the riser assembly, increasing the stress in the tension members and tending to draw the vessel structural swivel 34 back to a position vertically above the manifold 12. Thus, as shown in FIG. 5, no separate anchors and anchor chains would be needed, thereby eliminating the expense of a separate anchoring system and also the common problem of tangling a conventional riser pipe in the anchor chains.

Figure 6:
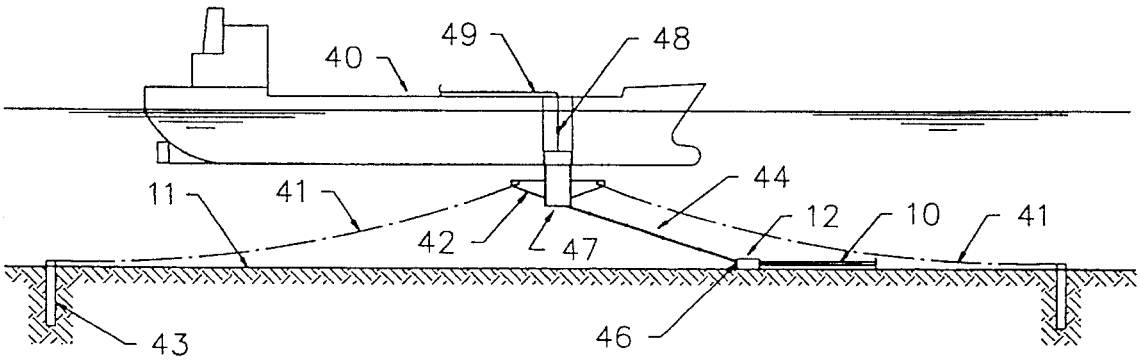
FIG. 6 is a side elevational view of a second embodiment of the riser assembly according to the present invention that is particularly adapted to shallow water conditions.
Figure 7:
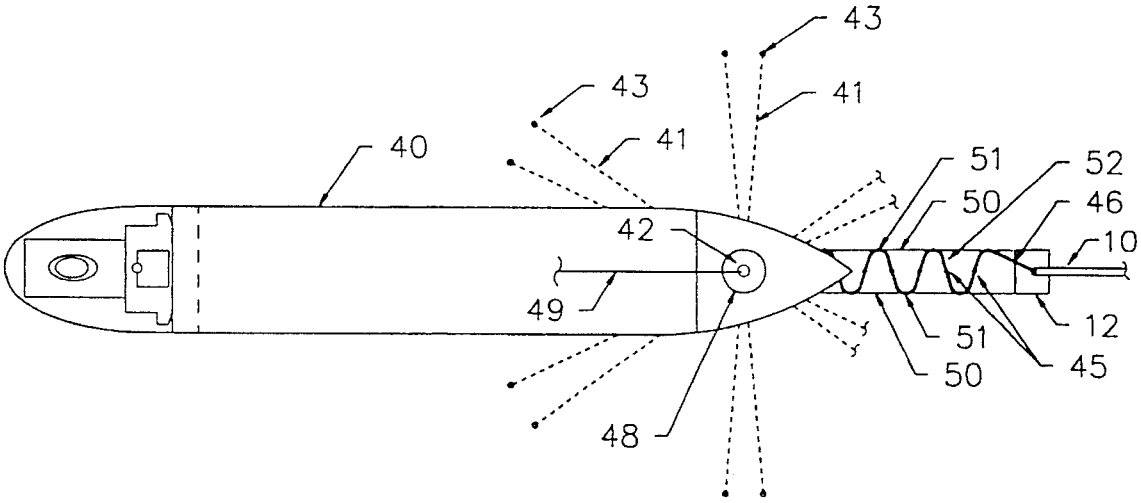
FIG. 7 is a plan view of the riser assembly embodiment of FIG. 6.

FIGS. 6 and 7 illustrate a second embodiment of a riser assembly according to the invention, with FIG. 6 showing a side elevational view and FIG. 7 showing the corresponding plan view. In these figures, a vessel 40 is moored in shallow water by mooring lines 41 extending from a structural mooring swivel 42 in the bottom of the vessel to stake piles 43 driven into the seabed 11.

A riser assembly 44 comprises a fluid conveying pipe 45 (see FIG. 7) formed in a planar cyclically undulating configuration, such as a sinusoid, having a first end 46 connected to the pipeline end manifold 12 on the seabed and a second end 47 connected through the mooring swivel 42 and a fluid swivel 48 to vessel piping 49. The riser assembly 44 further comprises at least one, and preferably two or more, flexible members such as stretched elastic ropes 50 (see FIG. 7). The ropes 50 are connected to the pipeline end manifold 12 at the first end 46 of the fluid conveying pipe 45 and to the structural swivel 42 at the second end 47 of the pipe 45. Preferably, the ropes 50 are also secured to the pipe 45 at intermediate points 51 where each rope contacts the pipe 45 at least once in each cycle of undulation.

As in the previous embodiment, buoyancy modules 52 may be attached to spaced apart locations on the fluid conveying pipe 45, in this case to control vertical deflections of the riser assembly 44. Also as in the previous embodiment, the fluid conveying pipe may include a plurality of pipes.

Figure 8:
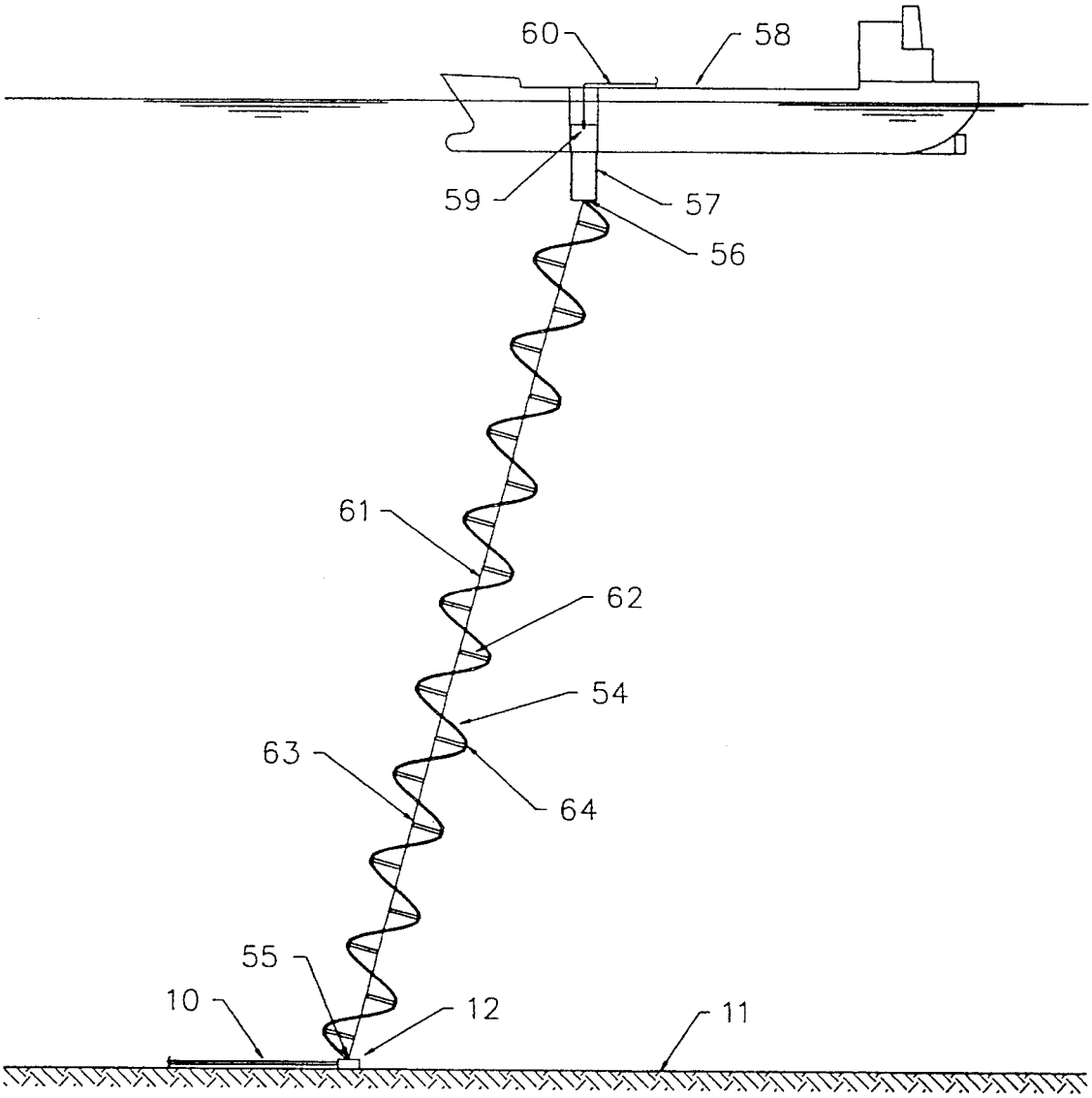
FIG. 8 is a side elevational view similar to FIG. 5 of a third embodiment of a riser assembly according to the invention.

FIG. 8 illustrates a third embodiment of a riser assembly 53 of the invention. This embodiment is similar to the first embodiment of FIG. 5 in that the riser assembly 53 comprises a helical fluid conveying pipe 54 having a first end 55 connected to the pipeline end manifold 12 on the seafloor and a second end 56 connected through a structural swivel 57 in the bottom of a floating vessel 58 and a fluid swivel 59 to vessel piping 60. In this case, however, the helical pipe 54 is supported by at least one flexible tension member such as elastic rope 61 extending in a line substantially coincident with the longitudinal axis of the helical pipe. The elastic rope 61 is maintained in this central position within the helix of pipe 54 by a plurality of spacer bars 62 extending radially from longitudinally spaced points 63 along the rope 61 to corresponding points 64 at longitudinally spaced intervals along the pipe 54.

Although several embodiments of the invention have been described, various modifications can be made without departing from the spirit and scope of the invention as defined in the following claims.

I claim:

1. A riser assembly for conveying fluid contents between the seabed and a floating vessel, wherein the riser assembly comprises:

at least one elongated fluid conveying pipe having a first end adapted to be located proximate to the seabed and a second end adapted to be located proximate to the surface of the sea, said pipe being formed in an undulating configuration about a longitudinal axis extending from the first end to the second end, and at least one flexible tension member secured to the fluid conveying pipe at at least two spaced apart points along a line extending generally parallel to the longitudinal axis.

2. A riser assembly according to claim 1 wherein the at least two spaced apart points of connection of the tension member are at the first and second ends of the fluid conveying pipe.

3. A riser assembly according to claim 2 wherein the tension member is secured to the fluid conveying pipe at additional longitudinally spaced points between the first and second ends of the pipe.

4. A riser assembly according to claim 3 wherein the at least one tension member comprises a plurality of substantially parallel members spaced from each other.

5. A riser assembly according to claim 1 wherein the fluid conveying pipe is formed in a helical configuration having a cylindrical outer envelope, and the at least one tension member comprises a plurality of tension members extending along lines that coincide with circumferentially spaced elements of the cylindrical envelope.

6. A riser assembly according to claim 5 wherein each tension member is secured to the fluid conveying pipe at spaced apart points intermediate the first and second ends of the pipe.

7. A riser assembly according to claim 6 wherein each tension member is secured to the fluid conveying pipe at intersections of the corresponding cylindrical element line with the pipe.

8. A riser assembly according to claim 1 wherein the fluid conveying pipe is formed in a helical configuration, and the at least one tension member extends along a line that coincides generally with the longitudinal axis, and the riser assembly further comprises spacer bars extending radially from the tension member to the pipe at longitudinally spaced intervals along the tension member.

9. A riser assembly according to claim 1 wherein each tension member is elastically stretchable to permit significant longitudinal extension of the riser assembly in response to increased tension forces imposed between the first and second ends of the fluid conveying pipe.

10. A riser assembly according to claim 9 wherein each tension member is selected from the group consisting of rubber rope, synthetic fiber rope, and steel wire rope.

11. A riser assembly according to claim 1 wherein each fluid conveying pipe comprises metallic pipe.

12. A riser assembly according to claim 11 wherein the metallic pipe is carbon steel pipe.

13. A riser assembly according to claim 1 wherein the at least one fluid conveying pipe comprises a plurality of pipes.

14. A riser assembly according to claim 13 wherein at least one of the plurality of fluid conveying pipes comprises a buoyancy control pipe.

15. A riser assembly according to claim 1 further comprising a plurality of buoyancy modules attached to the fluid conveying pipe at spaced apart intervals along the fluid conveying pipe.

* * * * *